US005601495A

United States Patent [19]

Silverman

[11] Patent Number: 5,601,495

[45] Date of Patent: Feb. 11, 1997

[54] BILLIARDS BALL RACK

[76] Inventor: Kenneth Silverman, 30 Treeview Dr., Melville, N.Y. 11747

[21] Appl. No.: 253,371

[22] Filed: Jun. 3, 1994

[51] Int. Cl.[6] ..... A63D 15/00

[52] U.S. Cl. ..... 473/40

[58] Field of Search ..... 473/40, 41; 273/40, 273/41

[56] References Cited

U.S. PATENT DOCUMENTS

| | | | |
|---|---|---|---|
| D. 159,558 | 8/1950 | Sundell | 473/40 |
| 464,745 | 12/1891 | Sweet | 273/22 |
| 916,193 | 3/1909 | Pierce | 473/40 |
| 1,052,461 | 2/1913 | Chase | 273/22 |
| 2,405,677 | 8/1946 | Volpe | 273/22 |
| 2,422,939 | 6/1947 | Volpe | 273/22 |
| 2,469,652 | 5/1949 | Jones | 473/40 |
| 3,253,826 | 5/1966 | Cook | 273/22 |
| 3,672,671 | 6/1972 | Merola | 273/22 |
| 3,863,919 | 5/1973 | Sardelli | 273/22 |
| 4,553,750 | 11/1985 | Kintz | 473/40 |
| 4,903,965 | 2/1990 | Smith | 273/22 |

*Primary Examiner*—Theatrice Brown
*Attorney, Agent, or Firm*— Graham & James LLP

[57] ABSTRACT

A frame or rack for creating a compact formation of billiard balls on a table. The interior of the side walls of the frame is angled inward to urge the balls into a compact formation. Sleeves, attached to the frame, house support legs. The relationship between the sleeves and the support legs provides for and controls the motion of the frame and likewise, limits undesired motion of the frame until the frame is clear of the ball formation. The player's effort is limited to pressing down on the frame to compact the ball formation, while springs within the sleeves bias the frame upward. Spring loaded contacts or projections may be housed within the inner walls of the frame to reduce contact between the balls and the frame.

11 Claims, 8 Drawing Sheets

BILLIARDS BALL RACK

BACKGROUND OF THE INVENTION

1. Technical Field

The present invention is directed to billiards, defined herein as any of several games played with hard balls that are driven with a cue on a cloth-covered table enclosed by a cushioned rim. Specifically, the present invention is directed to a device for setting and arranging the balls on the surface of the billiard table for play.

2. Background Information

In playing the game of pocket billiards, the balls are typically arranged on the surface of the billiards table via a frame. For the game commonly known as eight-ball, fifteen balls are placed within an independent triangular frame which is located on the table. The frame is moved on the table until the balls are in a desired spot, and once this has been achieved, the frame is removed, leaving the balls on the table in a specific formation or "rack". The player propels the cue ball toward the rack, with the desired result of separating the balls such that the balls are moved to various locations on the table surface.

The most common formation used in billiards is a triangular arrangement of the balls, but there are various other configurations used by billiards players, for example, a diamond arrangement is used for the game of nine-ball.

As a player's skill increases, the initial break up of the rack may become an opportunity for locating individual balls into definite locations on the table. The ability for such precise performance is dependent on the force and angle of the cue ball's contact with the rack. In order for the player to have such control, it is desired for the balls in the rack to be as close together as possible. The optimal formation of the balls has every ball in direct contact with its neighboring balls.

To make the initial placement of the balls within the frame easier, the frame is usually larger than the total size of the balls placed in formation. The extra room in the frame allows the balls to be easily inserted and allows the frame to be removed with only limited contact with the balls in the rack. As the extra room in the frame does not place the balls in their optimum proximity, the player's fingers are often used to tighten the formation, either by inserting the player's fingers into the frame between the frame and the balls or, if the frame is flexible, by squeezing the frame.

One problem with using a simple frame arises when players use their fingers to tighten the ball formation by touching the balls directly. When there is contact between skin and the ball formation, such contact rarely separates without a certain amount of adhesion. This adhesion has a tendency to separate the balls in the formation, preventing a tight formation from occurring. The dirtier the player's hands, the greater the adhesion factor becomes. In general, it is desired that the player not touch the balls in the formation.

Another problem which has arisen in the use of the existing frames occurs when the frame is removed from the ball formation. Until the frame has been completely removed from the formation, there exists the possibility that the player, in lifting the frame, may move the frame such that there is unplanned and undesired contact with one or more balls. Examples of such unplanned contact would occur when the player lifts the frame unevenly and one or more balls are dislodged from the tight formation created within the frame. Such contact loosens the formation, sometimes to the extent that the frame must be replaced down on the table to rack the balls again.

SUMMARY OF INVENTION

The present invention is an apparatus to group a plurality of balls in a compact formation on a billiards table, where the apparatus comprises a frame with angled side walls forming an opening to contain the balls, a plurality of sleeves attached to the side walls of the frame, and a plurality of support legs housed within the sleeves, where the sleeves allow the support legs to move between an extended position and a retracted position. The motion of the frame is controlled while the frame is near the balls. By controlling the motion of the frame after the balls are in a compact formation, the present invention eliminates the problems that occur using existing frames. Contacts or projections within the inner walls of the frame are provided to reduce the contact between the balls and the frame.

In using the present invention, the player places the invention on the billiards table and puts the billiards balls into the frame. The player then presses the frame down toward the table, causing the support legs to retract into the sleeves. The angles of the interior walls will urge the balls into a compact formation. In an alternative configuration, the contacts or projections may be used in conjunction with or instead of the angled interior walls to urge the balls into a compact formation. The player then releases the pressure applied to the rack, which rises up vertically and ceases to be in contact with the billiards balls. The player may then remove the invention from the table and continue the game.

DESCRIPTION OF THE PREFERRED EMBODIMENTS

Figure 1:
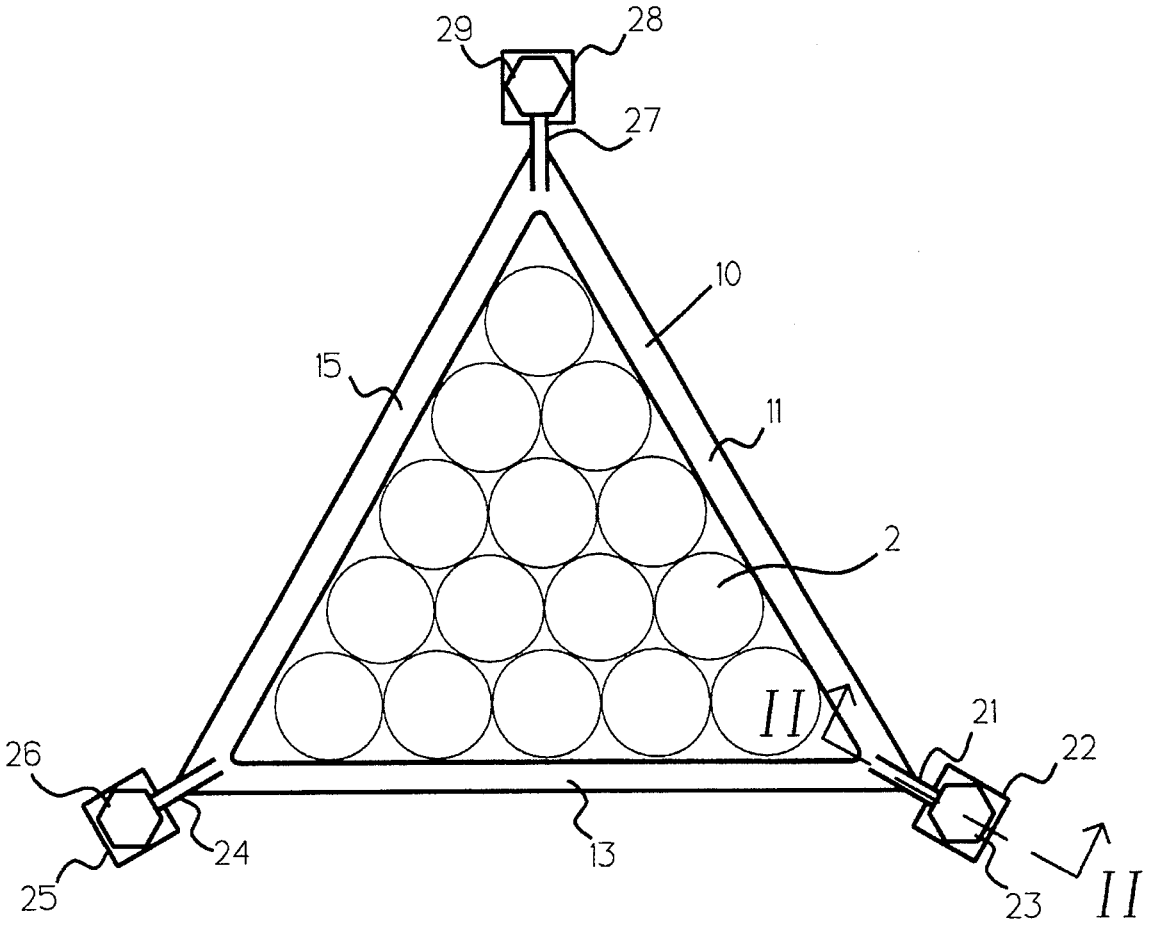
FIG. 1 is a top view of the present invention as a triangular frame, showing the standard number of balls for the game of "eight-ball" located within the frame.

As shown in FIG. 1, a top view of the present invention, frame 10 has three side walls 11, 13 and 15, defining a triangular opening for placing billiard balls 2 therein. In the course of playing billiards, frame 10 is placed on the surface of the billiards table and billiards balls 2 are placed within the defined opening.

Figure 2:
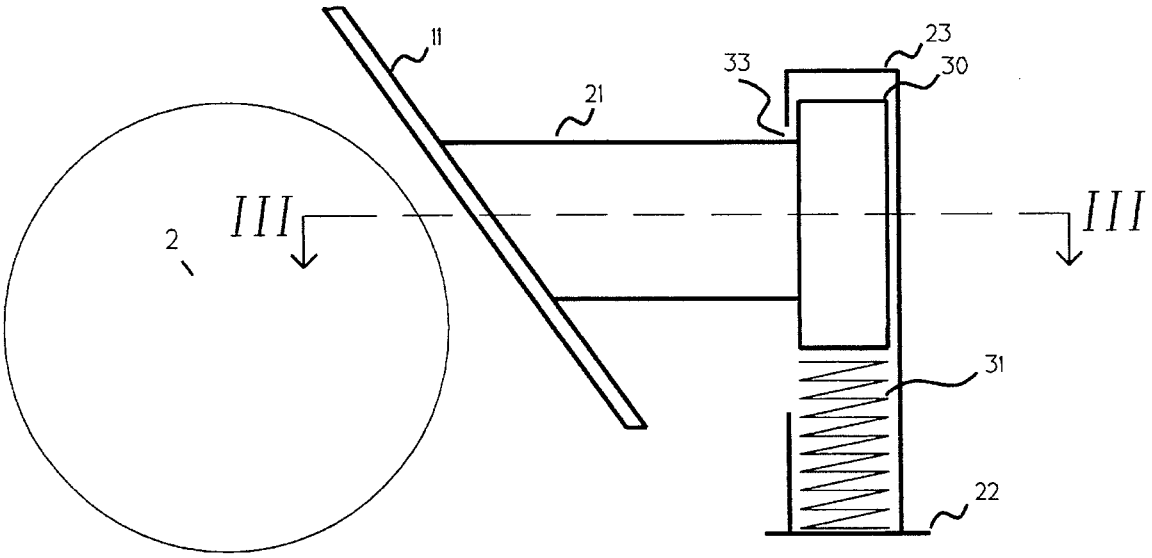
FIG. 2 is a side cross-sectional view along the line II—II of FIG. 1, showing one embodiment of the support leg and sleeve construction of the present invention, with the rack biased away from the table, showing the relative position of one of the balls.

In the preferred embodiment, side walls 11, 13 and 15 are inclined at an angle as shown in more detail with reference to FIG. 2. The three leg and sleeve constructions, shown at the corners of frame 10 as elements 21 through 23, 24 through 26, and 27 through 29 are identical to each other in the preferred embodiment, but may differ from each other within the scope of the present invention. Representative elements 21 through 23 are shown in greater detail in FIGS. 2 and 3.

Turning now to FIG. 2, a side cross-sectional view, support leg 30 is attached to side wall 11 by strut member 21. Support leg 30 is housed within sleeve 23, which fits securely around the support leg. Sleeve 23 limits the movement of support leg 30 to motion in one direction, which in the preferred embodiment is perpendicular to the surface of the billiards table. As shown in greater detail in FIG. 3, the cross-sections of the support leg and the sleeve aid in limiting motion to one direction. A variation on the preferred embodiment might have the motion of the support leg limited to a direction that is not perpendicular to the surface of the billiards table.

As used herein and as shown in the drawings, the word "foundation" means a support footing. Foundation member 22 is attached to the bottom of sleeve 23 and rests upon the surface of the billiards table. Foundation member 22 may be cushioned or have additional material attached to reduce lateral movement of the frame, as would be obvious to one skilled in the art.

Opening 33 is provided in sleeve 23 to allow strut member 21 to move relative to sleeve 23. In the preferred embodiment, opening 33 is a narrow slot limiting motion of the strut member to one direction, parallel to the side of sleeve 23 and perpendicular to the surface of the billiards table, as may be seen more clearly in FIG. 3.

Resilient spring member 31 located within sleeve 23 between support leg 30 and foundation member 22 biases the support leg and the frame away from the table. This resilient spring member may be any form of resilient device, such as helical springs, leaf springs, or any other type of resilient pressure device known to those skilled in the art.

Pressure upon the frame by the player will be in opposition to the bias provided by the resilient spring members. When such pressure is applied, the frame will be moved in closer proximity to the table.

Side wall 11 is shown inclined relative to the surface of the billiards table. This inclination provides for limited contact between the billiards balls and the frame, as well as providing the means for urging the balls into a compact formation.

As can be appreciated by one skilled in the art, pressing the frame into closer proximity with the billiards table in conjunction with the inclination of the side walls of the frame will urge the balls into a tighter formation within the frame. During the downward progression of the frame, the side walls of the frame will contact the balls and the inclination of the side walls of the frame will translate the frame's vertical motion into a force directing the balls into the desired compact formation. In the preferred embodiment, the side walls are all inclined to the same degree, however, different side walls of the frame may be inclined at different angles within the scope of the present invention, including an embodiment which has only one side wall inclined.

In an alternate embodiment, the interior and exterior of the frame side walls need not be parallel, but rather the exterior of the frame side walls could be angled differently.

Figure 3:
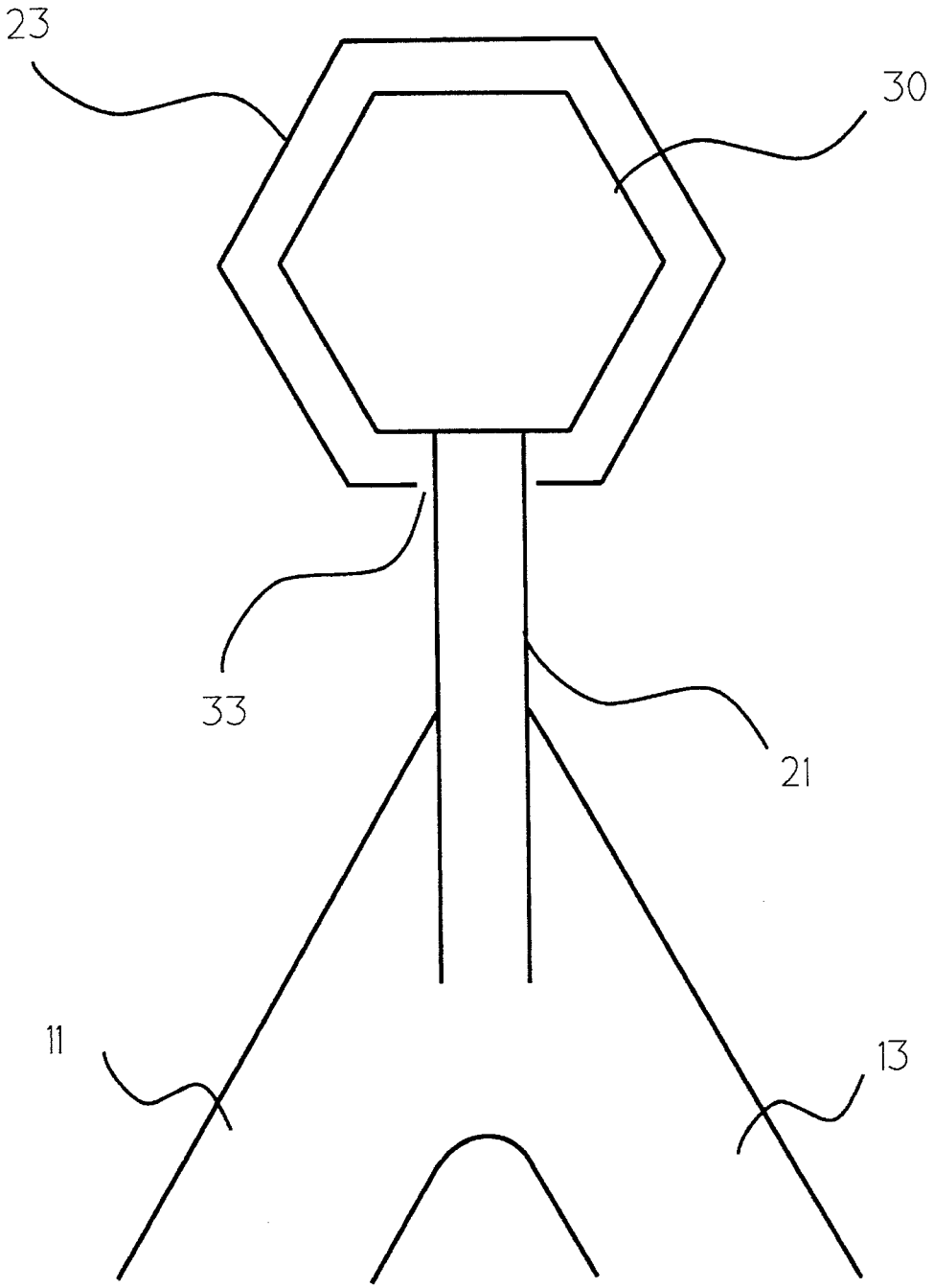
FIG. 3 is a cross-sectional view of the support leg and sleeve construction along the line III—III of FIG. 2.

Turning now to FIG. 3, a cross-sectional view of the support leg and sleeve construction, the cross-sections of sleeve 23 and support leg 30 are shown to be regular polygons. The cross-sections of the sleeves and the support legs may be of any shape, for example, circular, rectangular or hexagonal. In the preferred embodiment, a hexagonal shape is employed in the sleeve and the support leg cross-sections. This shape need not be a regular or equilateral polygon as that shown in FIG. 3. Lateral motion of the frame will preferably be reduced by using the identical shape in the sleeve and support leg cross-sections.

Opening 33 in sleeve 23 is wide enough for strut member 21 to move freely in a direction perpendicular to the plane of the surface of the billiards table. Opening 33 restricts lateral movement of strut member 21 and support leg 30, thereby increasing the stability of the frame.

Figure 4:
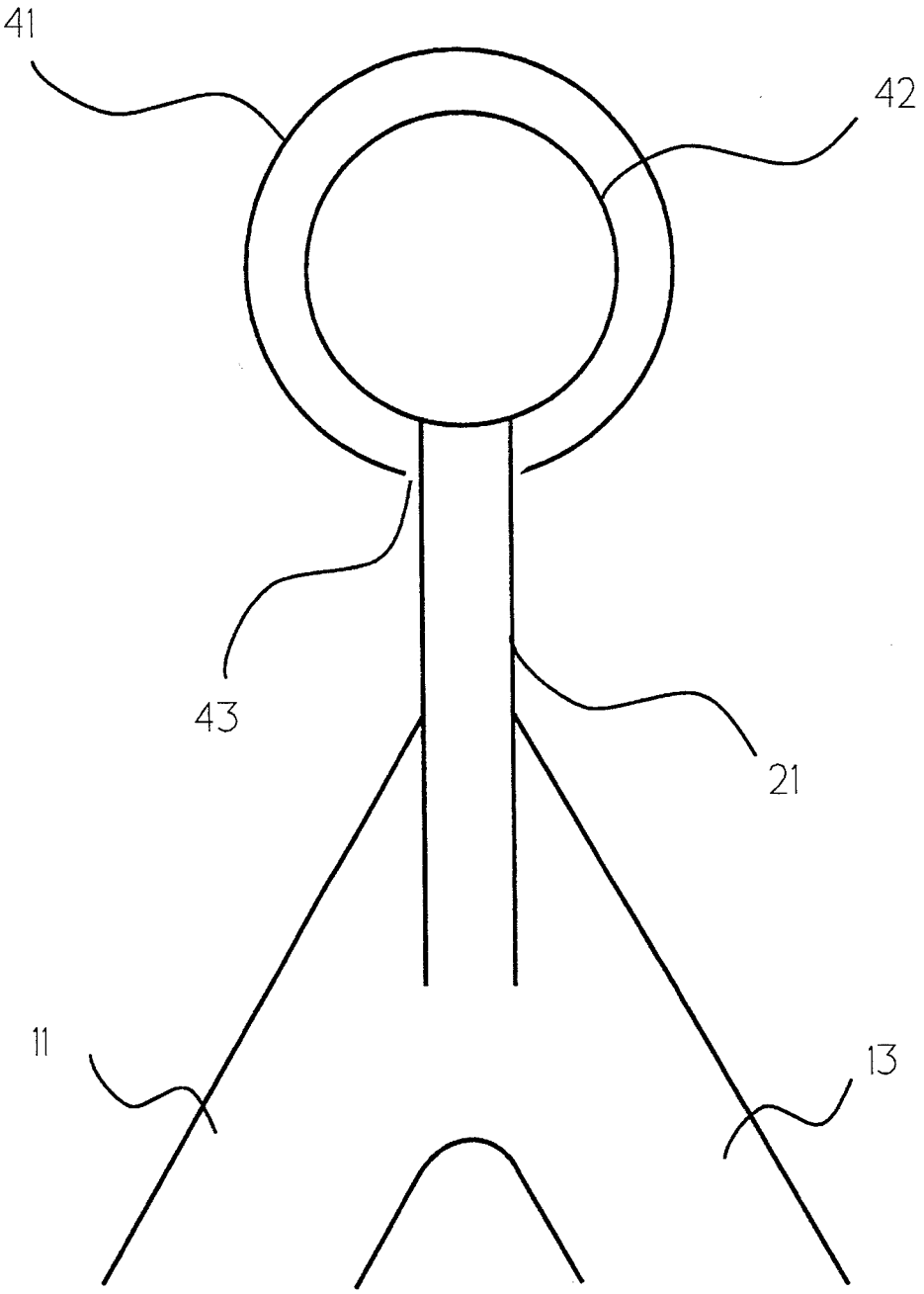
FIG. 4 is a cross-sectional view of an alternate embodiment of the support leg and sleeve construction.

Turning now to FIG. 4, a cross-sectional view of an alternate support leg and sleeve construction, a different embodiment is shown where support leg 42 and sleeve 41 have circular cross-sections, but perform the same functions as the preferred embodiment shown in FIG. 3.

Figure 5:
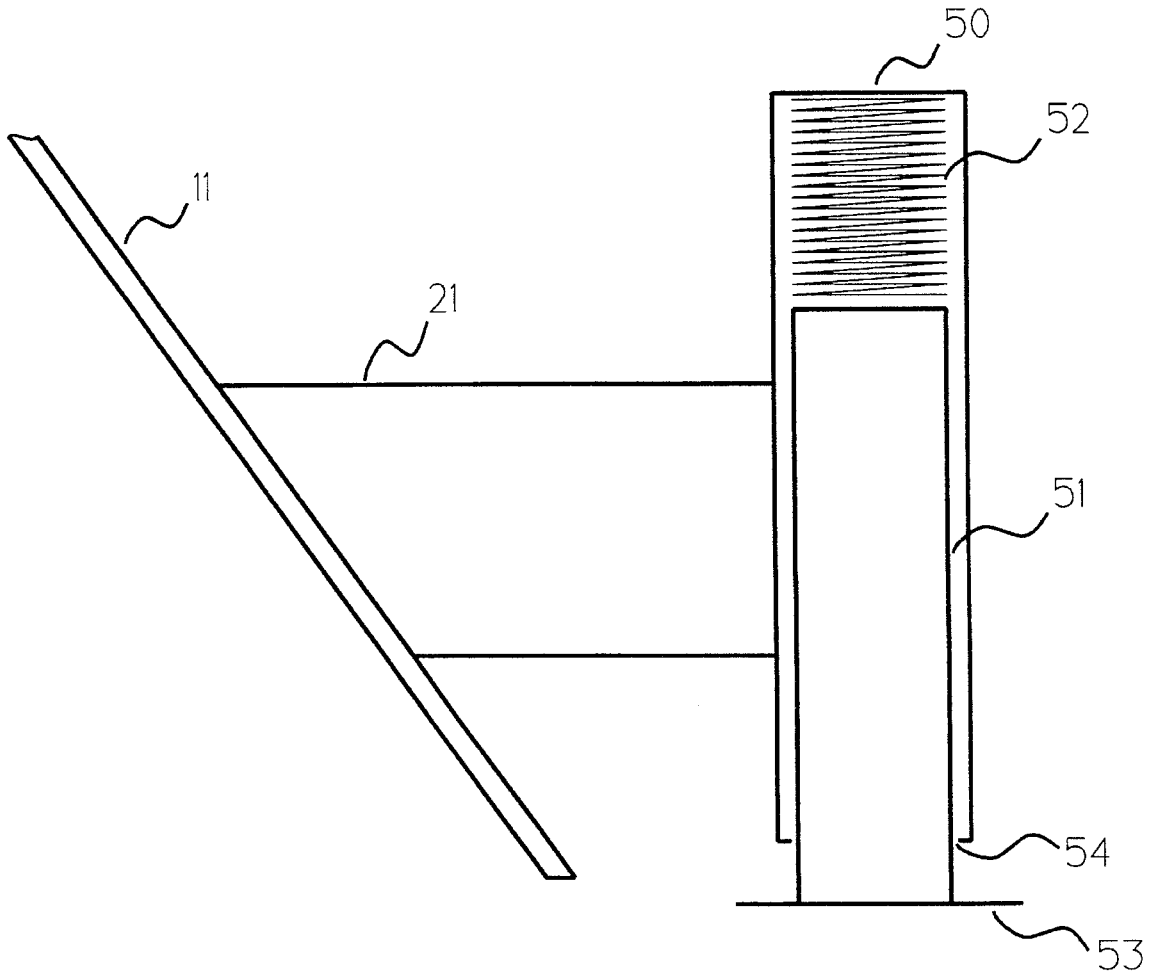
FIG. 5 is a side cross-sectional view showing a different embodiment of the support leg and sleeve construction of the present invention.

Turning now to FIG. 5, a side cross-sectional view of another alternate support leg and sleeve construction, the sleeves and the support legs of the present invention are shown reversed such that sleeve 50 is attached to the frame by strut member 21, and support leg 51 is housed within sleeve 50. In this alternate embodiment, resilient spring member 52 is located at the top of sleeve 50, biasing support leg 51 down toward the surface of the billiards table, thereby biasing the frame away from the surface of the billiards table.

It is within the scope of the present invention that sleeve 50 may be attached directly to the frame, without strut member 21. Within this alternate embodiment, it is contemplated that sleeve 50 may be an integral component of the frame and may be entirely contained within the side walls of the frame.

Opening 54, located at the bottom of sleeve 50, allows support leg 51 to extend downward to the surface of the billiards table. Opening 54 permits movement perpendicular to the surface of the billiards table and limits lateral movement of the support leg.

Foundation member 53 is attached to the bottom of support leg 51 to provide greater stability for the invention and may be enhanced as noted above in ways known to those skilled in the art.

Figure 6:
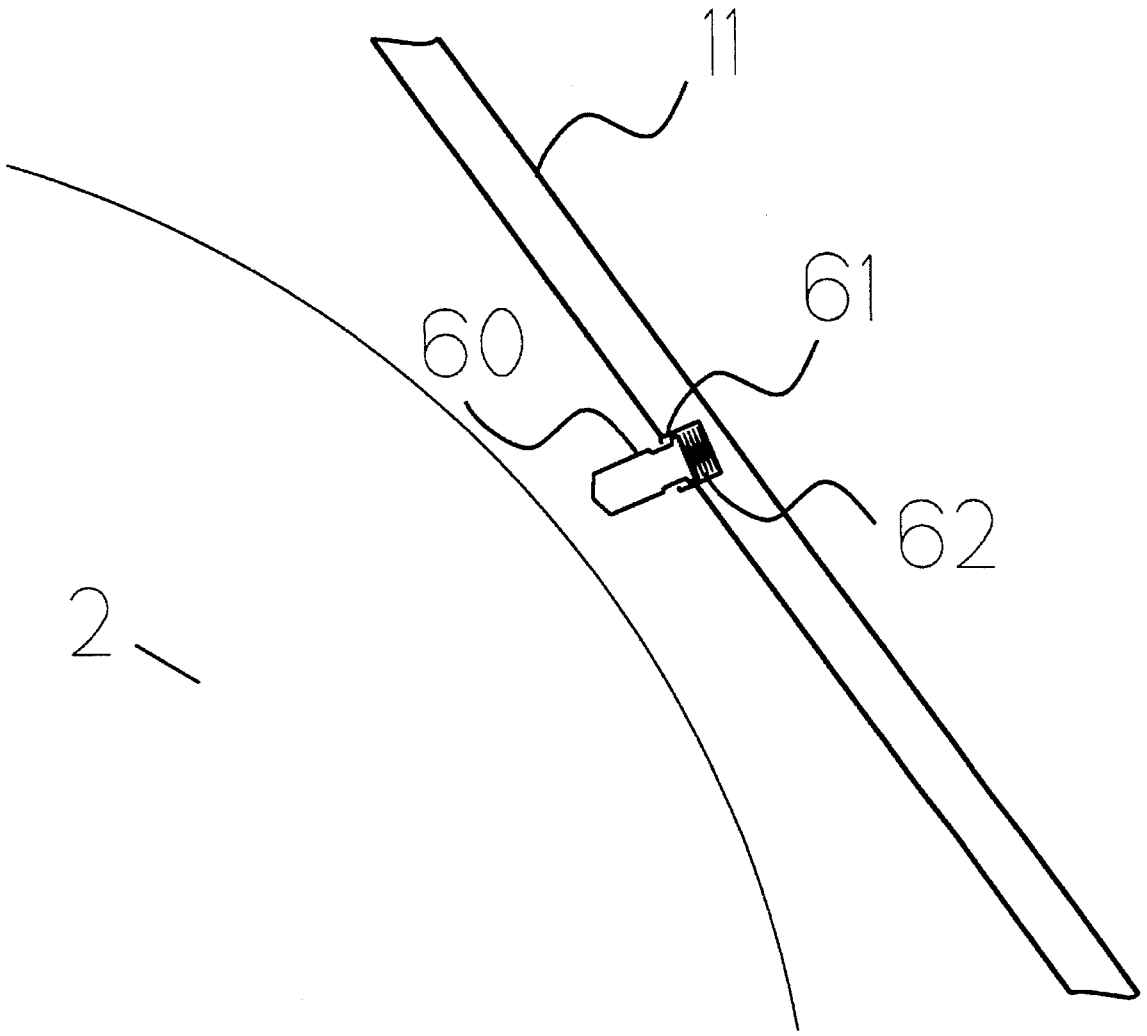
FIG. 6 is a side cross-sectional view showing a contact housed within a side wall of the frame.

Turning now to FIG. 6, a side cross-sectional view of the side walls of the present invention, contact 60 is shown housed within cavity 61 within side wall 11. In the preferred embodiment the contacts are located at the point where the curve of the billiards balls engages the side walls of the frame when the frame is pressed down to compact the ball formation. The location of the cavities may vary within the side walls of the present invention, and may be dependent on the inclination of the side walls of the frame. As can be appreciated by one skilled in the art, contacts or projections reduce friction between the billiards balls and the frame by limiting the surface area of the contact between the balls and the frame.

Resilient member 62 biases contact 60 toward the center of the frame. When the contact engages the billiards balls, pressure is applied to resilient member 62 in opposition to the bias of the resilient member. This resilient spring member may be any form of resilient device, such as helical springs, leaf springs, or any other type of resilient pressure device known to those skilled in the art.

When the pressure applied to the resilient member 62 is released, the contact will continue to touch the billiards ball after the billiards ball ceases to be in contact with the frame. The resilient member will bias the contact to apply pressure to keep the billiards ball in the formation during the initial stages of the frame's removal from the ball formation.

The location and number of support leg and sleeve constructions attached to the frame need not occur as is shown in the preferred embodiment of FIG. 1. It is recommended that there be no fewer than two support leg and sleeve constructions for a stable embodiment of the present invention. Any number of support leg and sleeve constructions greater than one may be employed to properly utilize the present invention. The legs may be located at the corners of the frame or may be located at any point along the side walls.

Figure 7:
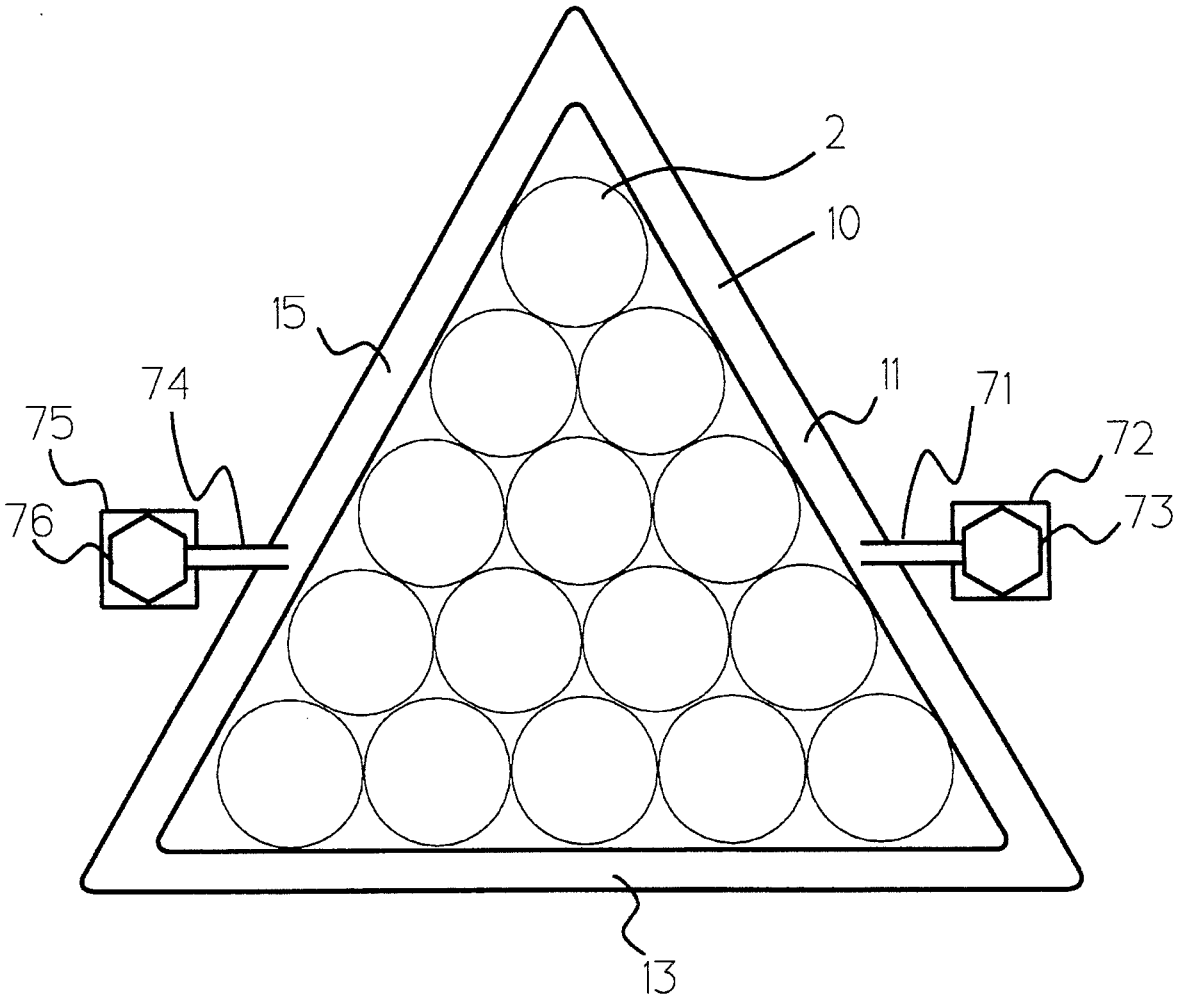
FIG. 7 is a top view of the present invention as a triangular frame showing two support legs in an alternate embodiment.

Turning now to FIG. 7, a top view of an alternate embodiment of the present invention, there is shown only two support legs and sleeve constructions located along the side walls of frame 10.

Strut members 71 and 74 connect frame 10 to support legs housed within sleeves 73 and 76 respectively, in the same fashion as discussed above in detail with reference to FIG. 2. Foundation members 72 and 75 are attached to sleeves 73 and 76 respectively, in the same fashion as discussed above in detail with reference to FIG. 2. As noted above with reference to FIG. 5, the sleeves and support legs may be reversed.

Figure 8:
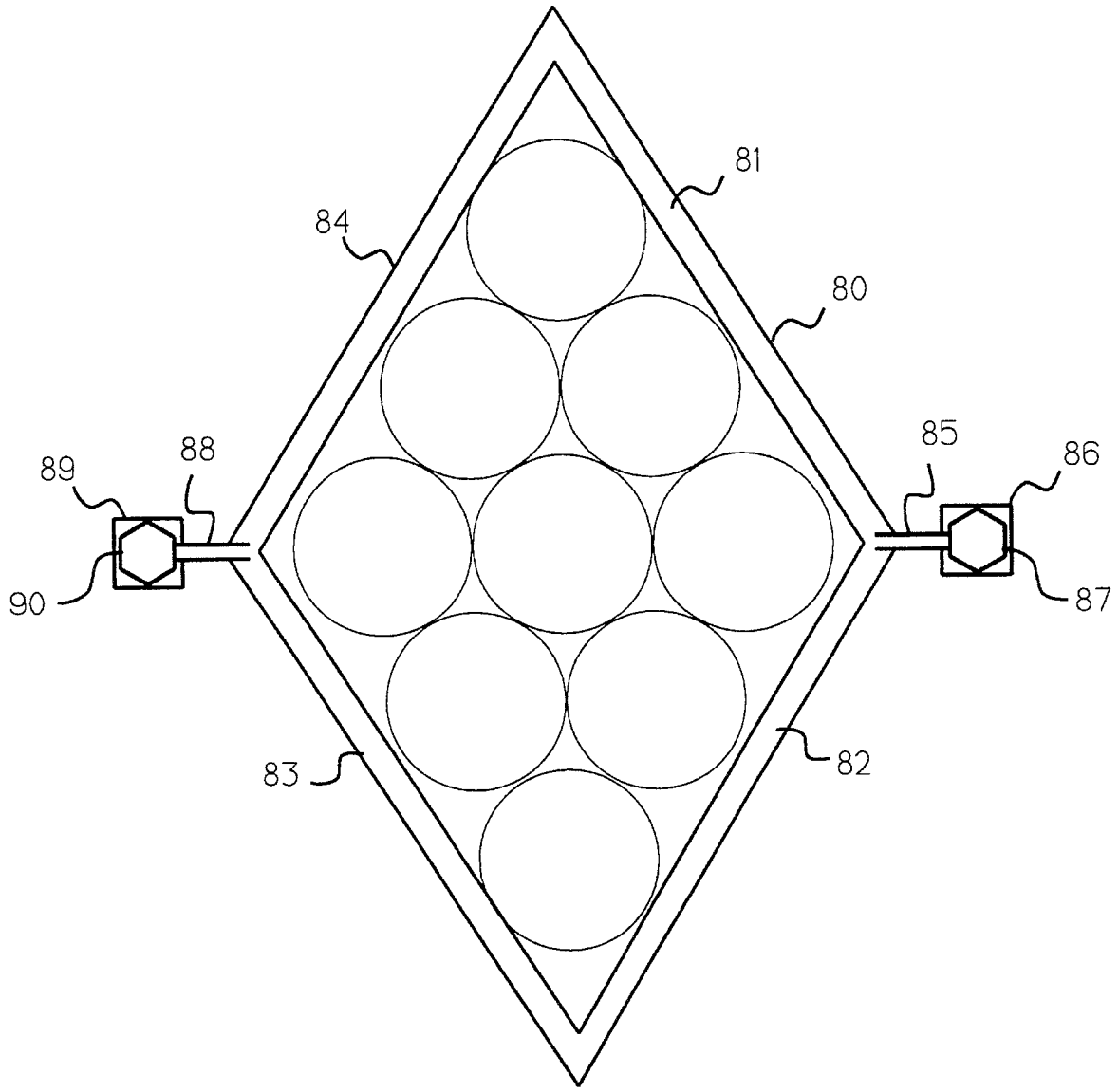
FIG. 8 is a top view of the present invention as a diamond-shaped frame such as is used in the game of nine-ball.

Turning now to FIG. 8, an alternate embodiment of the present invention is shown where frame 80 is diamond-shaped with side walls 81, 82, 83 and 84 containing sufficient balls for the billiards game of nine-ball.

Strut members 85 and 88 connect frame 80 to support legs housed within sleeves 87 and 90 respectively, in the same fashion as discussed above in detail with reference to FIG. 2. Foundation members 86 and 89 are attached to sleeves 87 and 90 respectively, in the same fashion as discussed above in detail with reference to FIG. 2. As noted above with reference to FIG. 5, the sleeves and support legs may be reversed.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. An apparatus to arrange a group of balls into a compact formation of a predetermined pattern on the playing surface of a billiards table, said apparatus comprising:

a frame having a plurality of side walls forming an opening, where the angle formed between the interior of at least one of the side walls and the playing surface of the billiards table is less than ninety degrees;

at least two elongated support legs attached to the side walls of the frame; and at least two elongated sleeves having a free end placeable on the billards table, movably mounted on the support legs and where said sleeves are adapted to be movable, relative to the support legs, between an extended position and a retracted position, wherein the group of balls placed within the frame are compacted when said sleeves are in the retracted position.

2. An apparatus as described in claim 1, further comprising:

means engaging said sleeves and support legs for biasing said frame in a direction away from the playing surface of the billiards table.

3. An apparatus as described in claim 1, further comprising:

a plurality of strut members, each strut member attaching one of the support legs to the side walls of the frame; and a plurality of slots, each sleeve having one of said slots extending along a side thereof wherein each strut member is capable of sliding in each slot as the support leg is moved relative to the sleeve.

4. An apparatus as described in claim 1, further comprising:

a footing member attached to said free end of each sleeve to thereby engage said playing surface of the billiards table.

5. An apparatus as described in claim 1, further comprising:

a plurality of projections located on the interior of at least one of the side walls of the frame, wherein said projections reduce the surface area of contact between the group of balls and said side wall and wherein said sleeves are located outward of the opening formed by the side walls.

6. An apparatus as described in claim 5, further comprising:

a plurality of wall sleeves located within the interior of the side walls of the frame, allowing said projections to move between an extended position and a retracted position relative to the wall sleeves and the side walls of the frame; and means for biasing the contacts or projections toward the center of the frame, where said biasing means is located within the wall sleeves.

7. A portable apparatus for arranging a group of balls into a compact formation of a predetermined pattern on a playing surface of a billiards table, said apparatus comprising:

a frame capable of compacting the group of balls into a prearranged pattern;

means for manually adjusting the height of the frame downward relative to the playing surface of the billiard table, said height adjusting means comprising a least two support legs attached to the frame; and at least two elongated sleeves having a free end placeable on the billiards table, where said sleeves are movably mounted on the support legs, and where said sleeves are adapted to be movable between an extended position and a retracted position relative to the support legs; and means for biasing said frame in a direction away from the playing surface of the billiards table.

8. An apparatus as described in claim 7, further comprising:

a plurality of strut members, each strut member attaching one of the support legs to the side walls of the frame; and a plurality of slots, each sleeve having one of said slots extending along a side thereof wherein each strut member is capable of sliding in each slot as the support leg is moved relative to the sleeve.

9. An apparatus as described in claim 7, further comprising:

a footing member attached to said free end of each sleeve to thereby engage said playing surface of the billiards table.

10. An apparatus as described in claim 7, further comprising:

a plurality of projections located on the interior of at least one of the side walls of the frame, wherein said projections reduce the surface area of contact between the group of balls and said side wall, and wherein said sleeves are located outward of the opening formed by the side walls.

11. An apparatus as described in claim 10, further comprising:

a plurality of wall sleeves located within the interior of the side walls of the frame, allowing said projections to move between an extended position and a retracted position relative to the wall sleeves and the side walls of the frame; and means for biasing the projections toward the center of the frame, where said biasing means is located within the wall sleeves.

* * * * *